US006527130B2

(12) United States Patent
Ruddy

(10) Patent No.: US 6,527,130 B2
(45) Date of Patent: Mar. 4, 2003

(54) METHOD AND SYSTEM FOR LOAD MEASUREMENT IN A CRANE HOIST

(75) Inventor: Thomas A. Ruddy, Roanoke, VA (US)

(73) Assignee: General Electric Co., Schenectady, NY (US)

( * ) Notice: Subject to any disclaimer, the term of this patent is extended or adjusted under 35 U.S.C. 154(b) by 167 days.

(21) Appl. No.: 09/784,920

(22) Filed: Feb. 16, 2001

(65) Prior Publication Data

US 2002/0144968 A1 Oct. 10, 2002

(51) Int. Cl.[7] ..... B66C 13/22

(52) U.S. Cl. ..... 212/278; 212/270; 212/275; 318/432

(58) Field of Search ..... 212/270, 275, 212/278; 340/685; 318/432

(56) References Cited

U.S. PATENT DOCUMENTS

| | | | | |
|---|---|---|---|---|
| 3,965,403 A | | 6/1976 | Okado | |
| 3,965,407 A | * | 6/1976 | Stoner | 318/432 |
| 4,031,440 A | * | 6/1977 | Christian et al. | 318/432 |
| 4,078,190 A | | 3/1978 | Nash | |
| 4,078,191 A | | 3/1978 | Morters et al. | |
| 4,093,898 A | * | 6/1978 | Morters et al. | 318/227 |
| 4,368,824 A | | 1/1983 | Thomasson | |
| 4,556,830 A | | 12/1985 | Schwalm et al. | |
| 4,752,012 A | | 6/1988 | Juergens | |
| 4,815,614 A | | 3/1989 | Putkonen et al. | |
| 4,953,053 A | | 8/1990 | Pratt | |
| 5,263,597 A | | 11/1993 | Stewart et al. | |
| 5,323,097 A | | 6/1994 | Kiiski | |
| 5,352,965 A | * | 10/1994 | Kawabata | 318/807 |
| 5,495,955 A | * | 3/1996 | Shibata | 212/275 |
| 5,732,835 A | | 3/1998 | Morita et al. | |
| 5,859,373 A | | 1/1999 | Munzebrock et al. | |
| 6,029,951 A | * | 2/2000 | Guggari | 354/269 |
| 6,079,576 A | | 6/2000 | Bosler et al. | |

FOREIGN PATENT DOCUMENTS

| | | |
|---|---|---|
| DE | 3623755 | 2/1988 |

* cited by examiner

*Primary Examiner*—Thomas J. Brahan
(74) *Attorney, Agent, or Firm*—Karl Vick; Kevin Duncan; Hunton & Williams

(57) ABSTRACT

The invention provides a load measurement in a crane hoist system. A parameter adaptation process uses a model of the system in order to measure the lifted load. A controller monitors hoist speed and hoist torque feedbacks that are input into the model and processed using a filter, as well as a previously determined load value. The model adapts automatically to determine the weight of the lifted load.

35 Claims, 3 Drawing Sheets

METHOD AND SYSTEM FOR LOAD MEASUREMENT IN A CRANE HOIST

FIELD OF THE INVENTION

This invention relates to a method and system to measure the load attached to a crane hoist. More particularly, the invention relates to a process for measuring the load lifted by a crane hoist by utilizing a parameter adaptation that uses drive speed and torque feedback as inputs.

BACKGROUND OF THE INVENTION

Many types of cranes are used to move loads in a wide variety of environments. In particular, container cranes are used to lift and move a wide range of loads between a ship and a dock. Illustratively, a container crane may include a crane structure, a drive system, a wire rope or cable, and a lifting device to connect to a container, for example. The crane structure may take on a variety of forms such as a trolley, a boom structure or a girder structure. The crane structure is movable such that a load may be raised, moved as necessary, then lowered to the desired position.

The conventional container crane includes a drive system that controls the hoisting of the load using a wire rope or cable. The drive system may include a hoist motor and a gearbox connecting the hoist motor to a hoist drum. The wire rope or cable is coiled on the hoist drum such that the wire rope may be payed out from or coiled upon the hoist drum as is known in the art. In a container crane system, the wire rope runs from the hoist drum through the crane structure to the lifting device. The wire rope may be of any suitable construction and is typically a steel cable.

The container crane system includes a lifting device. Illustratively, the lifting device may be a spreader or a cargo beam, for example. The spreader is commonly used in hoisting containers, for example. The spreader commonly includes twist locks to attach the spreader to the container. A different type of lifting device such as the cargo beam may be used for heavier loads. The cargo beam may be used in conjunction with slings. Illustratively, a boat may be hoisted and moved using a cargo beam lifting device.

The primary objective of a crane is to move a load from a first position to a second position. It is common for a crane design to make use of constant power operation of the hoist. This allows lighter loads to be moved at higher speeds, while heavier loads are moved more slowly. As a result, this increases the efficiency of the hoist without creating a need for a very large hoist motor design. Accordingly, the load must be measured dynamically in order to compute the maximum safe speed at which the load may be moved, according to the constant power curve. In performing this objective and in order to optimize efficiency, the container crane must measure the weight of the load as quickly as possible, while providing limited overshoot in the measurement.

However, one difficulty arises in measuring the load accurately while accelerating the load. In known container cranes, two methods are presently used to measure a lifted load. A first method includes the utilization of load cell feedback. This method accepts a load indication from the load cells placed on crane sheaves or headblock of a crane hoist, for example. However, due to accelerating forces, the signal generated from the load cell is typically inaccurate during changes in speed of the hoist. As a result, the load is more slowly accelerated to the maximum safe speed for that load.

A further known method utilizes drive speed and torque feedback to measure the load. In this additional method, the speed feedback is filtered, differentiated, and multiplied by inertia to approximate acceleration torque. A loss profile is programmed to approximate the frictional losses in the system as a function of the speed or some other variable. These frictional losses are subtracted from the torque feedback signal to provide an indication of load torque, which is then filtered and scaled to provide the lifted load. This additional method provides good accuracy in a steady state, but experiences errors during changes in speed because of the difficulty in differentiating speed feedback to approximate acceleration. Accordingly, this second method cannot be adjusted to respond fast enough and with enough accuracy to provide any protective features which might be utilized in operation of the crane hoist.

Another, slightly different way to do this is to filter and differentiate a speed reference instead of speed feedback. This has similar dynamic problems because it cannot remain accurate if the hoist drive hits an electrical current or torque limit. However, it is common for a crane hoist to hit an electrical current or torque limit because the crane hoist system is sized to use all available current to provide the best performance possible.

Accordingly, as described above, drive current and speed feedbacks can be used to determine the load lifted by a container crane, for example. Once the load is known, the maximum safe speed of operation is determined. However, the conventional techniques can be unstable and always rely heavily on the tune-up of the hoist motor control system that is utilized.

SUMMARY OF THE INVENTION

Thus, there is a particular need for a crane hoist system to overcome these problems. Briefly, in accordance with one embodiment of the present invention, a parameter adaptation method utilizes a model of the physics of the crane hoist system in order to measure the weight of a lifted load. The system and method of the invention utilize the model of a crane hoist system and the on-line parameter adaptation technique to measure the load accurately and with a faster response than was possible in known systems.

In the invention, the load measurement process measures the lifted load by a crane hoist by applying an on-line parameter adaptation. The parameter adaptation utilizes drive speed feedback of the hoist motor system and torque feedback of the hoist motor system as inputs. In particular, the parameter adaptation filters the drive speed feedback and the torque feedback of the hoist motor system, and processes these filtered values in conjunction with a previously determined load measurement. Additionally, the method and system of the invention provide the accuracy, as well as the speed of response, to detect certain fault conditions of the hoist. Specifically, the process of the invention allows for slack cable detection, overload protection, as well as snagged load detection.

BRIEF DESCRIPTION OF THE DRAWINGS

The present invention can be more fully understood by reading the following detailed description of presently preferred embodiments together with the accompanying drawings, in which like reference indicators are used to designate like elements, and in which.

DETAILED DESCRIPTION

In the invention, the adaptation process of the invention utilizes a transfer function between hoist torque and speed to provide an accurate measurement of the weight of the load in real time. Illustratively, with a crane hoist system it should be appreciated that there are certain limitations on the crane hoist system that are based on power. That is, in hoisting a particular load, the power capability of the crane hoist system must not be exceeded. The adaptation process of the invention provides an accurate measurement of the load. Then, the crane hoist system of the invention adjusts the maximum speed of lifting or lowering the load according to the measured weight of the load, in such a manner so as not to exceed the limitations of the crane hoist system.

The transfer function between the hoist torque and the speed, when lifting a load, has an inertial component and a fixed component. The inertial component is affected only when the hoist motor speed is changed, i.e., when there is an acceleration or deceleration of the load. In contrast to the inertial component, the fixed component is present at all times. The adaptation process in accordance with one embodiment of the invention is given the inertial component and provides a measurement of the fixed component associated with lifting the load. As a result, the adaptation process is measuring one component of the transfer function. In other words, the adaptation process of the invention measures the constant piece of the transfer function and derives the load measurement from that constant piece. The other information is provided to the adaptation process in order to make this load measurement. Such information includes the torque feedback and the speed feedback, which are both variable quantities, as well as the inertia component of the mechanical system, which is a fixed quantity. The inertia component is tuned or determined when the crane is commissioned.

Figure 1:
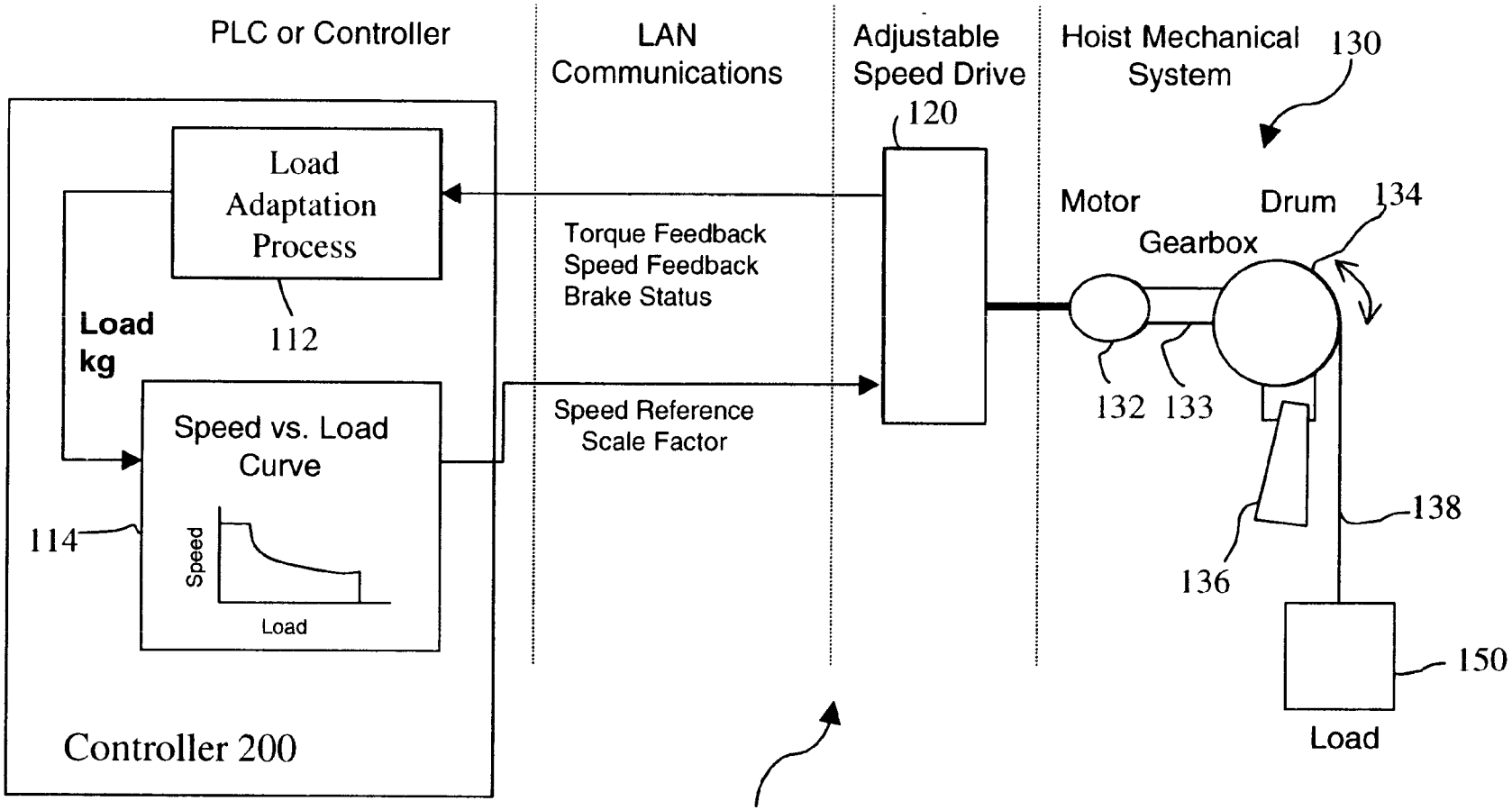
FIG. 1 is a diagram showing a crane hoist system in accordance with one embodiment of the invention.

FIG. 1 shows an illustrative crane hoist system 100 in accordance with one embodiment of the method and system of the invention. The crane hoist system 100 utilizes the adaptation process of the invention. As shown in FIG. 1, the crane hoist system 100 includes a controller 200, an adjustable speed drive 120, and a hoist mechanical system 130, which raises and lowers a load 150.

The controller 200 may be in the form of a programmable logic controller (PLC), for example, or any other controller receiving feedbacks from the hoist mechanical system 130. The controller 200 includes a load measurement portion 112 and a speed-load portion 114. The load measurement portion 112 utilizes the adaptation process in accordance with one embodiment of the method and system of the invention.

The hoist system 100 also includes an adjustable speed drive 120. The adjustable speed drive 120 controls operation of the hoist mechanical system 130, and specifically the motor 132. The adjustable speed drive 120 is in communication with the controller 200 via a local area network (LAN), for example. However, it should be appreciated that any suitable manner of communication between the adjustable speed drive 120 and the controller 200 may be utilized. The adjustable speed drive 120 outputs torque feedback, speed feedback and brake status to the controller 200.

It should further be appreciated that any suitable manner of determining the torque feedback and/or the speed feedback may be used. Accordingly, the speed feedback may be determined using a tachometer or a speed sensor. Further, speed feedback may be determined from a speed sensor attached to the motor 132, or alternatively, speed feedback derived by the adjustable speed drive 120, for example. Further, the torque feedback could come from a torque sensor, or alternatively, from a torque feedback derived by the adjustable speed drive 120.

Based on the torque feedback, the speed feedback, and the brake status from the adjustable speed drive 120, the load measurement portion 112 in the controller 200 outputs a measured load to the speed-load portion 114, as shown in FIG. 1, in accordance with one embodiment of the invention. In turn and based on the load measurement from the load measurement portion 112, the speed-load portion 114 outputs a speed reference scale factor to the adjustable speed drive 120 to control operation of the adjustable speed drive 120 to prevent the hoist from exceeding the power limit described above.

The speed-load portion 114 may utilize a speed versus load curve to provide constant power operation of the hoist, for example, in order to provide an appropriate speed reference scale factor. However, it should be appreciated that any suitable method may be utilized to associate a particular input load measurement with a particular speed reference scale factor. For example a look-up table might be utilized. Further, it should be appreciated that the speed-load portion 114 is not limited to providing a constant power operation of the hoist. That is, it is not necessary to utilize constant power. Rather, any speed-load curve, or other relationship between load and acceptable speed, that defines the limitations of the crane capability may be utilized by the speed-load portion 114. Operation of the controller 200 and the adjustable speed drive 120 are discussed further below.

As described above, the adjustable speed drive 120 controls the motor 132. Illustratively, the adjustable speed drive 120 takes fixed frequency AC power and converts that power into adjustable frequency and adjustable voltage for an AC motor or adjustable voltage for a DC motor 132. Accordingly, the method and system of the invention may use either an AC or DC motor 132.

With reference to FIG. 1, the hoist mechanical system 130 includes a motor 132, gearbox 133, a drum 134, brake 136 and a cable 138. In accordance with operation with the hoist system 100, the hoist mechanical system 130 raises and lowers the load 150. Operation of the motor 132 is controlled by the adjustable speed drive 120. In turn, the motor 132 is operationally connected to the gearbox 133, which is connected to the drum 134. As a result, the motor 132 and gearbox 133 effect rotation of the drum 134 as is necessary or desired. The cable 138 is wrapped around the drum 134 in the conventional manner.

As shown in FIG. 1, a brake 136 may be utilized to brake the drum 134. As a result, the brake 136 may sustain the lifted load 150. For example, the brake 136 may be used when the load 150 is suspended by the hoist mechanical system 130 in a static condition, i.e., when the load 150 is not being raised or lowered. As a result, it is not necessary for the motor 132 to suspend the load 150 in such a static condition, thus conserving energy.

It should be appreciated that the crane hoist system 100 as shown in FIG. 1 may be positioned on a crane structure (not shown). That is, the crane hoist system 100 is responsible for lifting and lowering a load 150. However, it should be appreciated that the crane hoist system 100 does not effect lateral positioning of a lifted load 150. Rather, such lateral positioning is accomplished using a crane structure such as a trolley. Accordingly, the hoist system 100 may be disposed on and movable with such a trolley.

However, it should further be appreciated that the crane hoist system of the invention may be utilized on any suitable crane structure. The crane structure accordingly moves the crane hoist system of the invention either laterally or rotationally, for example, as desired. Accordingly, the system and method of the invention are not limited to any particular crane structure.

In the invention, both drive speed and hoist torque inputs are utilized to measure the weight of a hoisted load. An adaptation process is used in this measurement of the weight of the lifted load. Hereinafter, aspects of the adaptation process are described. When hoisting a load, equations representing run torque and acceleration torque are as follows:

$$\text{Run Torque}_H \text{ (when hoisting)}, Trun_H = Ld \cdot \frac{g \cdot r}{eff} \quad \text{Eq. 1}$$

$$\text{Accel Torque}_H \text{ (when hoisting)}, Tacc_H = \alpha \cdot \left(Jm + Ld \cdot \frac{r^2}{eff}\right); \text{ and} \quad \text{Eq. 2}$$

$$\text{Max Torque}_H = \text{Run Torque}_H + \text{Accel Torque}_H; \quad \text{Eq. 3}$$

where:

Jm=inertia of the mechanical system (kg $m^2$);

r=effective radius of the gearbox and drum (m) defined as $$\frac{\text{linear_speed}}{\text{motor_rpm} \cdot 2 \cdot \pi};$$

eff=efficiency of the mechanical system;

$\alpha$=vertical acceleration of the load;

g=acceleration of gravity; and

Ld=lifted load including spreader (kg).

It should be appreciated that when raising a load, the efficiency of the system works against the hoist motor. Upon review of equations 1 and 2, it should be recognized that "efficiency" is present in the denominator. Accordingly, as efficiency increases, both run torque and acceleration torque will decrease when hoisting a load. In contrast, when lowering a load, the efficiency of the hoist system works in favor of the motor. Accordingly, equations 1 and 2 are modified to represent the torque when lowering a load as shown in equations 4 and 5 as follows:

$$\text{Run Torque}_L \text{(when lowering)}, \text{Trun}_L = Ld \cdot g \cdot r \cdot \text{eff} \quad \text{Eq. 4}$$

$$\text{Accel Torque}_L \text{(when lowering)}, \text{Tacc}_L = \alpha \cdot (Jm + Ld \cdot r^2 \cdot \text{eff}) \quad \text{Eq. 5}$$

$$\text{Max Torque}_L = \text{Run Torque}_L + \text{Accel Torque}_L \quad \text{Eq. 6}$$

In contrast to equations 1 and 2, in equations 4 and 5 the efficiency term is present in the numerator. Accordingly, as efficiency decreases, both the run torque and the acceleration torque also decrease when lowering a load. For example, the efficiency of the hoist mechanical system 130 may depend on the frictional forces present in the system. Accordingly, as the frictional forces increase, the torque exerted by the motor 132, for example, necessary to counter the downward force of the load is decreased. This is because the friction is in fact supporting a small portion of the load, thus reducing the portion of the load that is supported by the motor 132. Accordingly, when lowering a load 150, the efficiency of the hoist mechanical system 130 works in favor of the hoist motor 132. In contrast, when raising a load, the efficiency of the hoist mechanical system 130 works against the motor 132. As shown in equation 6, the maximum torque when lowering a load equals "run torque when lowering" plus "acceleration torque when lowering."

Equations 1–6 as set forth above define known transfer functions between the motor torque and speed. These transfer functions are the basis for the parameter adaptation process in the invention. In accordance with one embodiment of the invention, equations 1–6 are combined into a single equation that represents the transfer function for all hoist movements.

Equations 1–6 are combined in the manner of determining the torque difference between hoisting and lowering an identical load. Specifically, the difference in torque between raising and lowering an identical load may be defined by:

$$\text{Tdiff} = \text{Max Torque}_H - \text{Max Torque}_L \quad \text{Eq. 6A}$$

Accordingly, the difference in torque between hoisting and lowering an identical load is represented by equation 7 as follows:

$$Tdiff = \alpha \cdot Ld \cdot r^2 \cdot \left(\frac{1}{eff} - eff\right) + Ld \cdot r \cdot g \cdot \left(\frac{1}{eff} - eff\right) \quad \text{Eq. 7}$$

In further explanation of equation 7, lifting of a load may require 1,000 newton-meters of torque. A portion of this 1,000 newton-meters of applied torque is used to overcome friction. Further, when lowering the same load, 800 newton-meters of torque may be required. When lowering the load, it should be appreciated that friction is assisting in stopping the load. Accordingly, the actual load is 900 newton-meters. That is, the actual load is the difference between the torque required to raise the load and the torque required to lower the load.

Upon review of equation 7, it should be appreciated that the first term is similar to an inertia value reflected to the motor shaft. That is, the first term has an affect only when acceleration is non-zero. The first term generally accounts for less than 10% of the total inertia of the system. That is, for a typical container crane hoist system, $\alpha \cdot Ld \cdot r^2 \leqq 10\%$ and efficiency $\geqq 0.87$.

Assuming that efficiency is unity would leave a maximum error of:

$$\frac{10\%}{2} \cdot \left(\frac{1}{0.87} - 0.87\right) = 1.4\%.$$

Thus, in accordance with one embodiment of the method of the invention, a simplifying assumption is applied to eliminate this first term on the right hand side of equation 7.

That is, the error in calculating acceleration torque would be approximately 1.4% of the total torque requirement. Additionally, for higher efficiencies, the error is even less. For this reason, efficiency in the load dependent inertia term is removed at this point in the derivation of the relationships used in the method of the invention, i.e., by removing the first term on the right hand side of equation 7. This results in:

$$Tdiff = Ld \cdot r \cdot g \cdot \left(\frac{1}{eff} - eff\right) \quad \text{Eq. 8}$$

As described above, equation 8 represents the difference in torque between hoisting and lowering an identical load.

The difference in torque is attributable to the efficiency of the drive system. Further, the efficiency of the drive system relates to the losses experienced in feeding and retrieving the cable 138. That is, when efficiency is optimized, then the losses experienced by the drive system are minimized. It should be recognized that when Tdiff in equation 8 is divided by two, this result defines the losses experienced by the hoist assembly. Further, losses may be characterized as the difference between drive torque feedback and the torque to run the load in steady state. In accordance with the description of the invention as set forth below, the losses are represented as acting to oppose motion. Accordingly, by multiplying the term in equation 8 by the sign of the speed feedback ensures the losses always act to oppose the motion. Accordingly, the torque loss "T loss" may be represented in equation 9 as follows:

$$Tloss = \frac{Ld \cdot r \cdot g}{2} \cdot \left(\frac{1}{eff} - eff\right) \cdot \text{sign}(sfb) \qquad \text{Eq. 9}$$

With equation 9 defining the torque loss, one can define a single torque equation as follows:

$$\text{Torque} = \alpha \cdot (Jm + Ld \cdot r^2) + Ld \cdot r \cdot g + \frac{Ld \cdot r \cdot g}{2} \cdot \left(\frac{1}{eff} - eff\right) \cdot \text{sign}(sfb) \qquad \text{Eq. 10}$$

The quantity "sign(sfb)", i.e., the sign of the speed feed back, is either positive (+1) or negative (−1) and accordingly controls the sign of the third term in equation 10. The sign of the speed feedback is defined as positive if the load is being raised, or alternatively, defined as negative if the load is being lowered.

Equation 10 defines the relationship between torque and load for any hoist speed. Note that not only is the sign of speed feedback included in the calculation, its derivative, is also included. Accordingly, torque can be expressed as the sum of three quantities. These quantities include acceleration torque, load torque, and torque losses, as set forth in equation 11:

$$\text{Torque}=\text{Tacc}+\text{Tload}+\text{Tloss} \qquad \text{Eq. 11}$$

Comparing to equations 3 and 6 in further explanation of the invention:

run torque=load torque+torque losses

The remainder of the derivation in accordance with one embodiment of the invention defines a method for measuring the load (Ld). Note that each component of torque may be defined independently. Thus, it should be appreciated that any convenient method of estimating the loss torque component (Tloss), as an alternative to equation 9 above, may be used. As long as the estimation is reasonably accurate, it does not affect the load measurement relationship.

In accordance with one embodiment of the method and system of the invention, the adaptation relationship is developed by defining the physical hoist system 100 as a vector of parameters multiplied by a vector of signals using the above relationships.

Of interest, the torque quantity as set forth in equation 10 includes the following signals:

$\alpha$=the acceleration of the hoist mechanical system; and sign(sfb)=the polarity of hoist speed feedback, as described above.

The only quantity that must be measured is:

Ld=lifted load.

Thus, in accordance with one embodiment of the method and system of the invention, the load (Ld) is measured during the hoist operation. The hoist system 100 measures the load as described further below.

It should be appreciated that the inertia (Jm) of equation 10 may be measured in some operating environments. However, it should be noted that Jm is generally constant for a hoist mechanical system. Also, the inertia (Jm) is easily tuned, i.e., determined, when the crane is being commissioned. As a result, it is not necessary to measure the inertia (Jm) during operation of the crane hoist system 100. Rather, the inertia quantity may be simply held as a constant based on the tuning during commissioning.

It should be appreciated that one problem with the torque equation (equation 10) as described above is that the acceleration ($\alpha$), which is the derivative of speed feedback, is difficult to measure directly. This difficulty may be due to noise and quantization of digital speed feedback, for example. Therefore, it is difficult to accurately subtract the acceleration torque from a torque feedback. In accordance with one embodiment of the method and system of the invention, a filtering technique is applied to the torque equation (equation 10) so the acceleration can be removed from the list of required signals, i.e., as required by equation 10. This may be accomplished by using a first order filter in the Laplace domain, i.e., the filter:

$\lambda/s+\lambda$

A transfer function defines the relationship between the inputs to a system and its outputs. The transfer function is typically written in the frequency, or 's' domain, rather than the time domain. The Laplace transform is used to map the time domain representation into the frequency domain representation.

Illustratively and in accordance with Laplace transform concepts, if x(t) is the input to the system and y(t) is the output from the system, and the Laplace transform of the input is X(s) and the Laplace transform of the output is Y(s), then the transfer function between the input and the output is:

$Y(s)/X(s)$=the Laplace transform.

Accordingly, based on Laplace transform concepts, the filtered torque ($T_f$) is defined as follows:

$$T_f = \frac{\lambda}{s+\lambda} \cdot T \qquad \text{Eq. 12}$$

Also, the filtered speed ($sfb_f$) is defined as:

$sfb_f=\lambda/s+\lambda \cdot sfb$; or rewritten as Eq. 13

$sfb_f s=\lambda \cdot sfb-\lambda \cdot sfb_f$ Eq. 14 where in equations 12–14:

$T_f$=filtered torque;

T=torque;

$\lambda$=filter cutoff frequency;

s=Laplace operator;

$sfb_f$=filtered speed feed back; and sfb=speed feed back.

Now, based on equation 10, the filtered torque equation can be written (substituting T for Torque) as:

$$\left(\frac{\lambda}{s+\lambda}\right)\left\{T = \alpha\cdot(Jm + Ld\cdot r^2) + Ld\cdot r\cdot g + Ld\cdot\frac{r}{2}\cdot g\cdot\left(\frac{1}{eff} - eff\right)\cdot \mathrm{sign}(sfb)\right\} \quad \text{Eq. 15}$$

The filter can be distributed through the equation. Note that the acceleration, α, may be rewritten as s·sfb, where s is the Laplace operator. The load term (Ld·r·g) is constant and the sign of $sfb_f$ may replace the sign of sfb in the loss term resulting in:

$$T\cdot\frac{\lambda}{s+\lambda} = s\cdot sfb\cdot\left(\frac{\lambda}{s+\lambda}\right)\cdot(Jm + Ld\cdot r^2) + Ld\cdot r\cdot g + \frac{Ld\cdot r\cdot g}{2}\cdot\left(\frac{1}{eff} - eff\right)\cdot \mathrm{sign}(sfb_f) \quad \text{Eq. 16}$$

Using equations 12, 13 and 14, in equation 16 substitute $\lambda\cdot sfb - \lambda\cdot sfb_f$ for $s\cdot sfb_f$, resulting in:

$$T_f = (\lambda\cdot sfb - \lambda\cdot sfb_f)\cdot(Jm + Ld\cdot r^2) + Ld\cdot r\cdot g + \frac{Ld\cdot r\cdot g}{2}\cdot\left(\frac{1}{eff} - eff\right)\cdot \mathrm{sign}(sfb_f) \quad \text{Eq. 17}$$

Rearrange and solve for sfb:

$$(\lambda\cdot sfb - \lambda\cdot sfb_f)\cdot(Jm + Ld\cdot r^2) = T_f - Ld\cdot r\cdot g - \frac{Ld\cdot r\cdot g}{2}\cdot\left(\frac{1}{eff} - eff\right)\cdot sign(sfb_f); \text{ and} \quad \text{Eq. 18}$$

$$sfb = \frac{T_f - Ld\cdot r\cdot g - \frac{Ld\cdot r\cdot g}{2}\cdot\left(\frac{1}{eff} - eff\right)\cdot sign(sfb_f)}{\lambda\cdot(Jm + Ld\cdot r^2)} + sfb_f: \quad \text{Eq. 19}$$

or alternatively: Eq. 20

$$sfb = \frac{T_f - Tload - Tloss}{\lambda\cdot Jt} + sfb_f;$$

where: $Jt$(total inertia)$=Jm+Ld\cdot r^2$

It should be appreciated that equations 19 and 20, in accordance with one embodiment of the method of the invention, reveal that the speed feedback is equal to the filtered speed feedback plus a term representing the acceleration torque (total torque less load and loss torques) divided by a total inertia value: "λ·Jt".

The derivation of an adaptation relationship will not be performed beyond this point, i.e., cannot be further simplified, because the load term as shown in equation 19 is present in both the numerator and denominator and cannot be easily separated. However, it is noted that the load has a relatively small impact on inertia, (<10% of Jt). As a result, the numerator term of equation 19 is used to derive the relationships in accordance with one embodiment of the method and system of the invention. Then, the resulting value for Ld is inserted in the denominator of equation 19 as an inertia adjustment. Thus, in accordance with this embodiment of the system and method of the invention, the denominator of equation 19 may be initially left out and such omission does not adversely affect convergence or stability. Accordingly, the relationship as set forth in equation 19 allows a value of load (Ld) to be determined based on torque feedback and speed feedback from the adjustable speed drive 120, as well as utilizing Laplace transform concepts.

Figure 2:
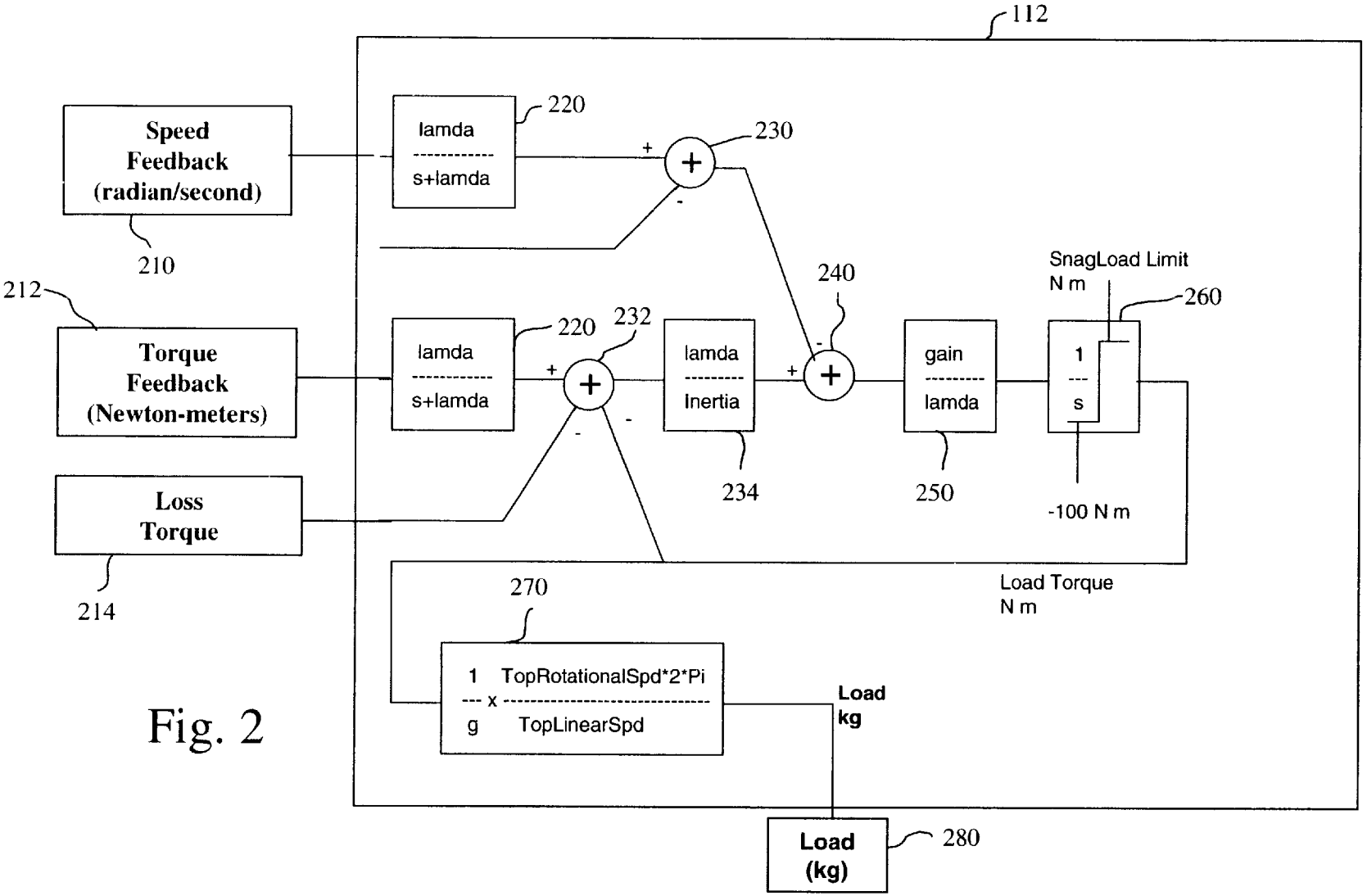
FIG. 2 is a block diagram showing the load measurement process in accordance with one embodiment of the invention.

FIG. 2 illustrates a block diagram illustrating operation of the load measurement portion 112, in the controller 200, showing the adaptation structure of the invention. As described below, the block diagram of FIG. 2 utilizes the relationship of equation 19.

As shown in FIG. 1, the load measurement portion 112 receives input from the adjustable speed drive 120. The input from the adjustable speed drive 120, as shown in FIG. 2, includes speed feedback input 210 and torque feedback input 212, as well as brake status. Also, a loss torque input 214 is input into the load measurement portion 112.

In accordance with the equations as set forth above, the speed feedback input 210 is filtered utilizing a filter 220. The sum junction 230 as shown in FIG. 2 then compares the filtered speed feedback value with the unfiltered speed feedback value. The resulting value from the sum junction 230 provides a measure of acceleration. In the situation where the acceleration is zero, i.e., the speed of the hoist is not changing, then the output from the sum junction 230 will be zero. However, if speed is changing, i.e., there is acceleration, then the resultant from the sum junction 230 is a number proportional to the acceleration.

As described above, the filter 220 may be a first order filter in the Laplace domain in accordance with one embodiment of the method and system of the invention. Further, it should be appreciated that the filter 220 approximates and replaces the differentiation otherwise necessary to determine acceleration from speed samplings. Also, the filter 220 utilizes previous speed feedback information. Specifically, it should be appreciated that the filter has a memory function implemented by the integrator 260, as shown in FIG. 2. The filter state is determined by the sum of all past inputs presented to the filter, so its output is a more accurate representation than a single sample of the input with a time delay.

Additionally, the controller 200 inputs the torque feedback input 212 as shown in FIG. 2. The torque feedback input 212 is also filtered using the filter 220. As a result, a filtered torque feedback value is provided as input to the sum junction 232, as shown in FIG. 2. This filtered torque feedback provides a value representing expected acceleration in accordance with one embodiment of the method and system of the invention.

The controller 200 also utilizes a loss torque input 214. Illustratively, the loss torque input 214 may be stored in memory. The loss torque input 214 is also input into the sum junction 232. Also, a load torque value is fed into the sum function 232.

That is, as described further below, a value for load torque is actually the output of the integrator 260. This load torque output from the integrator 260 is used in the adaptation process of FIG. 2, since equation 19 requires such a load torque value.

To further explain, the relationship of equation 19 should hold true if the present load torque value is correct, i.e., if the load torque value currently used by the system is correct. The block diagram of FIG. 2 implements the relationship of equation 19. That is, the sum junction 230 represents the quantity: sfbf−sfb. Also, the sum function 232 represents the numerator in equation 19. The denominator in equation 19 is processed in the adaptation process of FIG. 2 utilizing the inertia component 234. Thus, part of the adaptation process of FIG. 2 includes subtraction of the present value of load torque, which is obtained from the integrator 260, from the filtered torque feedback value.

Accordingly, in steady state when acceleration is zero, then the output of the sum function 232 is zero when the present load torque value is correct. This is true since:

filtered torque=loss torque+load torque and thus the numerator of equation 19 is zero.

Also, when acceleration is taking place, the present load torque is correct when the output of the sum junction 240 is zero. This is true since the relationship of equation 19 is satisfied. Relatedly, it should be appreciated that when the input to the integrator 260 equals zero, the load torque value is correct, i.e., the load torque output by the integrator 260 is correct.

In further explanation of the adaptation process shown in FIG. 2 and in further detail, the resultant value from the sum junction 232 represents torque feedback minus the load torque value and also minus losses of the mechanical hoist system, such as frictional losses, for example. The resultant value from the sum junction 232 is adjusted utilizing an inertia component 234. Thereafter, the adjusted filtered torque feedback is input into the sum junction 240. In the sum junction 240, the adjusted filtered torque feedback is compared with the output of the sum junction 230. That is, the measured acceleration generated by the sum junction 230 is compared with the expected acceleration generated from the torque feedback. The difference in these values is then output by the sum junction 240. Essentially, the sum junction 240 performs a determination of whether the relationship of equation 19 is satisfied by the present load torque that is applied.

Thus, the sum junction 240 subtracts the actual acceleration from the expected acceleration. Accordingly, the output of the sum junction 240 provides an error value. If no error, the output is zero. The error value is then processed by the gain portion 250 to provide an adjusted error value, i.e., based on the gain. The particular value or manner of application of the gain utilized may be determined in any suitable manner. Further, it should be appreciated that the gain may be tuned, i.e., adjusted, for a particular operating environment.

The adjusted error value output from the gain portion 250 constitutes a load torque signal. Thereafter, the load torque signal is processed through the integrator 260 to determine a snagged load condition, in accordance with one embodiment of the invention. Additionally, the signal output from the integrator 260 may be processed to determine a slack cable situation, an overload situation, or a tachometer loss situation, for example. This protection is done by analyzing the load torque signal, either prior to or directly after the gain portion 250.

It should be appreciated that since the load measurement of the invention uses drive torque feedback, it cannot measure a load greater than the torque limit of the drive. The motor and drive are always applied such that the torque limit includes acceleration and run load. Thus, when the load torque is measured to be very close to the torque limit, the load torque must indicate a snag condition. As soon as the load is measured above the threshold, a snagged load fault is declared and the motor 132 is immediately brought to a stop. There is no filtering performed on this signal prior to stopping the motor 132. Any delay caused by filtering could cause mechanical damage to result to the crane hoist system.

The load torque value output from the integrator 260 is used in two manners. Firstly, the load torque value is input into the sum function 232, as described above. As a result, the present state of the system is used in the determination of the next error signal. Secondly, the load torque value output from the integrator 260 is used to control the torque applied in the hoist mechanical system 130.

That is, the load torque value is input into the conversion portion 270. The conversion portion 270 converts the measured load torque to a measured load, in accordance with an illustrative embodiment of the invention. Thereafter, the conversion portion 270 provides a measured load output 280 in kilograms, or any other mass or weight quantity measurement.

With reference to FIG. 1, the measured load output is then input into the speed-load portion 114, as shown in FIG. 1. As described above, the speed-load portion 114 then generates a speed reference scale factor. The speed reference scale factor is output to the adjustable speed drive 120. The adjustable speed drive 120 then controls the actual speed of the hoist based on the speed reference scale factor, i.e. accelerating or maintaining the speed as is dictated by the speed reference scale factor. Accordingly, the measured load is utilized in real time to control the speed of the hoist of the load 150. The adjustable speed drive 120 multiplies the operator or automation speed reference by the reference scale factor. The top allowable speed is modified by the scale factor to respect the power limit in the speed-load curve.

Figure 3:
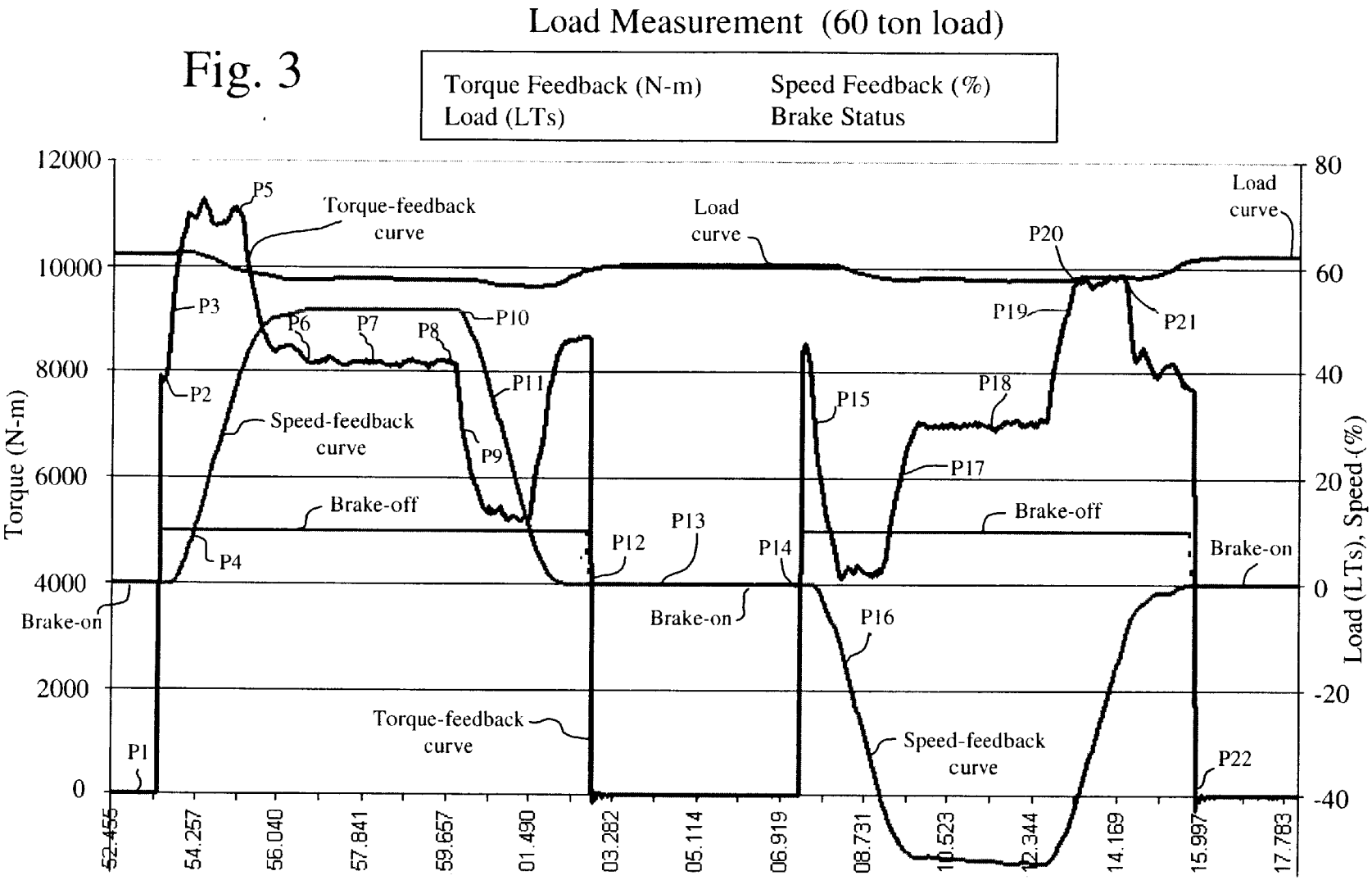
FIG. 3 is a graph showing load measurement, speed and torque in the adaptation process in accordance with one embodiment of the invention.

In accordance with one embodiment of the method and system of the invention, FIG. 3 is a graph showing load measurement over a period of time. As shown in FIG. 3, the graph includes a load curve; a torque feedback curve; and a speed feedback curve. With reference to FIG. 1, the torque feedback curve illustrates data that the controller 200 receives from the adjustable speed drive 120 in operation of the crane hoist system 100. Similarly, the speed feedback curve illustrates data received in the controller 200 from the adjustable speed drive 120. Further, the load curve illustrates the load measurement's output from the controller 200 to the speed-load portion 114, as shown in FIG. 1.

Illustratively, the graph of FIG. 3 shows a situation in which an operator has stopped a sixty ton load in midair. For example, the operator may have stopped for some reason, such as to talk to persons on the ship, or alternatively, may have stopped to move the load from a first position to a second position. As shown in FIG. 3, the torque (Newton meters) is shown in the left-hand side of the graph. Also, the load (LTS) and speed (%) is shown on the left-hand y axis. The advancement of time is shown along the bottom of the graph. FIG. 3 will hereinafter be described with reference to FIG. 1.

As shown in FIG. 3, the brake is initially set and holding the load. Accordingly, at point P1, the torque is zero. When the operator is ready to again raise the load, the brake is released and the torque is applied that is necessary to hold the load as shown at point P2. The torque level at point P2 is generally at the same level as the steady state torque at point P7, described below. Thereafter, at point P3 the operator is commanding the system to raise the load, and the adjustable speed drive effects an increase in torque and as a result the upward speed of the load, i.e. raising of the load, is increased as shown at point P4, in FIG. 3. The result of the operator's speed command is a torque to raise the load until is moves at the commanded speed Subsequent to point P5 on the torque feedback curve, the torque is reduced because the acceleration has ended and only the steady state torque (Trun+Tloss) is needed to maintain a constant speed. It remains generally constant after point P6. Since torque after point P6 is constant, then speed will also be constant. Thus, the time between point P6 and point P7 may be characterized as a steady state in which the load is being raised at a constant speed.

It should be appreciated that the load curve illustrates the load measured by the load measurement portion 112. Further as may be seen from FIG. 3, the measured load experienced in upward acceleration of the load and the load measured during steady state is substantially the same. That is, the variance of the measured load is less that one half of a ton. Accordingly, the graph of FIG. 3 shows that the load adaptation process of the invention consistently measures the load accurately through both acceleration and steady state stages of the hoisting process.

Further, FIG. 3 depicts that the acceleration that takes place between point P2 and point P6 is approximately two seconds. As a result, it should be appreciated that the adaptation process of the invention is determining a very close approximation of the actual load very quickly. Further, the graph of FIG. 3 shows the stability of the load measurement. That is, even though the load is experiencing an acceleration or, as described below a deceleration, the load measurement is very stable. Accordingly, whenever the break is released, the adaptation process of the invention quickly generates an accurate load measurement.

Accordingly, the graph of load measurement shown in FIG. 3 illustrates two advantages, for example, of the method and system of the invention. Firstly, the load measurement of the method of the invention is not effected by a change in speed during the hoisting process. As shown in FIG. 3, the load measurement stays within approximately 5% accuracy. In addition to accuracy through a change in speed, the method of the invention also provides accuracy regardless of whether the load is accelerated or moved up or down. Thus, the adaptation process of the invention provides an accurate, stable measurement of the load that is independent of the speed at which the load is moving or the rate of change of speed.

As shown in FIG. 3, the time period between point P6 and point P8 illustrates a steady state at which time the load is raising at a constant speed. Illustratively, the speed during steady state may in fact be the maximum speed. To explain, with a crane hoist system it should be appreciated that there are certain limitations on the crane hoist system that are based on power. That is, in hoisting a particular load, the power capability of the crane hoist system must not be exceeded. The adaptation process of the invention provides an accurate measurement of the load. Then, the crane hoist system 100 of the invention actually adjusts the maximum speed according to the weight of the load to respect the power limitation. As described above, this adjustment is performed utilizing the speed-load portion 114, as shown in FIG. 1. Illustratively, the adjustment in speed may be performed utilizing an adjustable speed drive 120. Thus, from the operator's perspective, the operator will simply command full speed. However, the crane hoist system 100 of the invention will limit the top speed to a speed that has been determined to be safe to run a sixty ton load, for example. Illustratively, as shown in FIG. 3, a sixty ton load may be safely run at 50% speed. Further, it should be apparent that as the weight of the load decreases, then the safe speed increases.

In summary, it is desirable for the operator to lift the load as fast as possible. However, it is the job of the crane hoist system 100 to prevent the operator from exceeding the capabilities of the hoist mechanical system 130.

FIG. 3 illustrates the situation in which a load is raised, as described above; then stopped; and thereafter lowered. As shown in FIG. 3, at point P9, the controller 200 is decreasing the applied torque. As a result, the load at point P10 and P11 is still rising but is decelerating. At point P12 as shown in FIG. 3, the load is brought to a halt and the brake is applied. Once the brake is set, the trolley, for example, upon which the crane hoist system 100 is located, may be moved to a desired location in order to subsequently lower the load to that desired location. Thus, at point P13, the load is suspended, the brake is set and the torque goes to zero:

At point P14 in FIG. 3, the trolley has reached the desired location, the brake is released and the torque is increased to hold the load. Thereafter, the torque is decreased, i.e., "run torque+deceleration torque" is a negative number, at point P15, for example, the load accelerates downwardly, i.e., at point P16 the speed feed back curve illustrates that the speed is increasing in a downward direction. Thus, points P15 and P16 illustrate acceleration torque being subtracted from the holding torque. However, it should be noted that the measured load as shown in FIG. 3 remains essentially constant.

Thereafter, at point P17 the controller 200, as shown in FIG. 1, is increasing the applied torque to slow the lowering of the load. Thereafter, a steady state is experienced at point P18. Specifically, at point P18 the torque is constant and the negative speed is constant.

Thereafter as shown in FIG. 3, at point P19 the controller 200 again increases the torque. This increased torque results in a deceleration of the downward speed of the load, i.e. the descent of the load is slowing. As may be seen in FIG. 3, between point P20 and point P21, show a time period in which the torque is essentially constant. As a result, the deceleration of the load is constant as the speed at which the load is lowered decreases. At point P22 in FIG. 3, movement of the load has stopped. As a result, the brake is on, the torque is zero, and the speed is zero.

As described above, the method and system of the invention provide an accurate manner in which to measure a lifted load. This accurate measurement allows utilization of useful safeguards in operation of the crane hoist system. For example, a snag condition may develop when lifting a load. To explain, containers in a container ship are commonly disposed in cells. The cells are just slightly larger than the container. As a result, as a container is hoisted out of one of these cells, by the crane hoist system 100, the container may become twisted in a manner such that the container becomes lodged, i.e., snagged, in the cell. Using the method of the invention, the controller 200 realizes that the load 150, i.e., the container, is not moving and uses this indication to immediately stop the hoist motion, thus limiting the damage caused by the snagged load.

Slack cable detection logic in the controller 200 compares the load measurement to a pre-defined level, typically 50% of the empty spreader weight. An adjustable time delay is included but may be set quite low (0.25 seconds) due to the accuracy of the load measurement. This indication prevents the operator from commanding the hoist in a down direction after the lifting device has landed, causing much slack in the hoist cables that must be taken up before motion can occur in the upward direction. When too much slack is in a cable, the potential exists for a cable to be pulled out of the cable guide, which houses the cable. The cable being pulled out of its guide causes mechanical damage and can even cut a cable in half. In accordance with one aspect of the method and system of the invention, the snagged load protection logic in the controller 200 compares the load measurement to a suitable threshold value.

The method and system of the invention may also provide overload protection. Overload protection logic compares the load measurement to a pre-defined overload level, typically 120% of the crane's rated lift. An adjustable time delay is included but may be set quite low, such as 0.25 seconds for example, due to the accuracy of the load measurement.

Further, the method and system of the invention may also provide tachometer loss protection. A tachometer loss fault is declared when the load measurement reaches its upper limit, i.e., a snagged load condition, or becomes less than 0 while speed feedback is <0.5%, or alternatively, some small number. This indicates that there is an inconsistency in the transfer function between speed and torque feedback that is used in the adaptation process. A tachometer loss fault can only happen when the speed feedback measurement is inaccurate.

In the above description of the invention and in the accompanying drawings, various units of measurement are used. However, it should be appreciated that the disclosure of such units is for purposes of illustration, and that any other suitable units of measurement may be used in the practice of the method and system of the invention, as is necessary or desired.

While the foregoing description includes many details and specificities, it is to be understood that these have been included for purposes of explanation only, and are not to be interpreted as limitations of the present invention. Many modifications to the embodiments described above can be made without departing from the spirit and scope of the invention, as is intended to be encompassed by the following claims and their legal equivalents.

What is claimed is:

1. A method for determining the load value of a lifted load in a hoist system, comprising:

determining a speed feedback value from the hoist system;

filtering the speed feedback value using a filter to provide a filtered speed feedback value;

determining a torque feedback value from the hoist system;

filtering the torque feedback value using the filter to provide a filtered torque feedback value;

inputting a previously determined load value;

comparing values, including comparing the speed feedback value, the filtered speed feedback value, the filtered torque feedback value and the previously determined load value to determine an error value; and determining a measured load value based on the error value.

2. The method according to claim 1, wherein the comparing includes the steps of:

determining the difference between the speed feedback value and the filtered speed feedback value to obtain an adjusted speed value;

determining the difference between the previously determined load value and the filtered torque feedback value to obtain an adjusted torque value; and determining the difference between the adjusted speed value and the adjusted torque value to determine the error value.

3. The method according to claim 1, the method further including:

determining a loss torque value; and determining an inertia value; and wherein the step of comparing values further includes comparing the loss torque value and the inertia value with the speed feedback value, the filtered speed feedback value, the filtered torque feedback value and the previously determined load value.

4. The method according to claim 3, wherein the comparing includes the steps of:

determining the difference between the speed feedback value and the filtered speed feedback value to obtain an adjusted speed value;

determining the difference between the filtered torque feedback value and a summation of the previously determined load value and the loss torque value to obtain a processed torque value;

processing the processed torque value using the inertia value to determine an adjusted torque value; and determining the difference between the adjusted speed value and the adjusted torque value to determine the error value.

5. The method according to claim 1, wherein the filtered torque feedback value is defined as:

$$T_f = \frac{\lambda}{s+\lambda} \cdot T \text{ where:}$$

$T_f$=filtered torque feedback value;

T=torque feedback value;

λ=filter cutoff frequency; and s=Laplace operator.

6. The method according to claim 1, wherein the filtered speed feedback value is defined as:

$$sfb_f = \frac{\lambda}{s+\lambda} \cdot sfb \text{ where:}$$

$sfb_f$=filtered speed feedback value;

sfb=speed feedback value;

λ=filter cutoff frequency; and s=Laplace operator.

7. The method according to claim 1, wherein the filtered torque feedback value is defined as:

$$T_f = \frac{\lambda}{s+\lambda} \cdot T \text{ where:}$$

$T_f$=filtered torque feedback value;

T=torque feedback value;

λ=filter cutoff frequency; and s=Laplace operator and the filtered speed feedback value is defined as:

$$sfb_f = \frac{\lambda}{s+\lambda} \cdot sfb \text{ where:}$$

$sfb_f$=filtered speed feedback value;

sfb=speed feedback value;

λ=filter cutoff frequency; and s=Laplace operator.

8. The method according to claim 7, wherein the Laplace operator represents information from at least one previous measured load value determination.

9. The method of claim 1, further including comparing the measured load value to a threshold value to determine a slack cable condition.

10. The method of claim 1, further including comparing the measured load value to a threshold overload value to determine an overload condition.

11. The method of claim 1, further including comparing the measured load value to a threshold value to determine a snagged load condition.

12. The method of claim 1, wherein the step of determining a measured load value based on the error value is performed using an adjustable gain.

13. A method for determining the load value of a lifted load in a hoist system, comprising:

determining a speed feedback value from the hoist system;

processing the speed feedback value including using a filter to filter the speed feedback value to provide a filtered speed feedback value, the processing further including comparing the filtered speed feedback value with the speed feedback value to provide an acceleration value;

determining a torque feedback value from the hoist system;

determining a loss torque value and an inertia value from the hoist system;

inputting a previously determined load value;

processing the torque feedback value including using the filter to provide a filtered torque feedback value, the processing further including adjusting the filtered torque feedback value using the loss torque value, the previously determined load value, and the inertia value to determine an adjusted filtered torque feedback value;

comparing the acceleration value with the adjusted filtered torque feedback value to determine an error value; and determining a measured load value based on the error value.

14. The method according to claim 13, wherein the filter includes a Laplace operator that represents information from at least one previous speed feedback value determination.

15. The method of claim 13, further including comparing the measured load value to a threshold value to determine a slack cable condition.

16. The method of claim 13, further including comparing the measured load value to a threshold overload value to determine an overload condition.

17. The method of claim 13, further including comparing the measured load value to a threshold value to determine a snagged load condition.

18. The method of claim 13 wherein determining the measured load value based on the error value includes:

determining a measured load torque value; and converting the measured load torque value to the measured load value.

19. The method of claim 18, wherein determining the measured load torque value based on the error value includes using an integrator to convert the error value to the measured torque value.

20. The method of claim 13, further including the step of associating the measured load value to a speed reference scale factor, the speed reference scale factor controlling the speed at which the load is lifted.

21. The method of claim 20, wherein the step of associating the measured load value to a speed reference scale factor is performed using a speed versus load curve.

22. A hoist system for determining the load value of a lifted load in a hoist system, comprising:

means for determining a speed feedback value from the hoist system;

means for filtering the speed feedback value using a filter to provide a filtered speed feedback value;

means for determining a torque feedback value from the hoist system;

means for filtering the torque feedback value using the filter to provide a filtered torque feedback value;

means for inputting a previously determined load value;

means for comparing values, including comparing the speed feedback value, the filtered speed feedback value, the filtered torque feedback value and the previously determined load value to determine an error value; and means for determining a measured load value based on the error value.

23. The hoist system according to claim 22, wherein the means for comparing:

determines the difference between the speed feedback value and the filtered speed feedback value to obtain an adjusted speed value;

determines the difference between the previously determined load value and the filtered torque feedback value to obtain an adjusted torque value; and determines the difference between the adjusted speed value and the adjusted torque value to determine the error value.

24. The hoist system according to claim 22, the method further including:

means for determining a loss torque value; and means for determining an inertia value; and wherein the means for comparing compares the loss torque value and the inertia value with the speed feedback value, the filtered speed feedback value, the filtered torque feedback value and the previously determined load value.

25. The hoist system according to claim 22, wherein means for determining the filtered torque feedback value uses the relationship:

$$T_f = \frac{\lambda}{s+\lambda} \cdot T \text{ where:}$$

$T_f$=filtered torque feedback value;

T=torque feedback value;

λ=filter cutoff frequency; and s=Laplace operator.

26. The hoist system according to claim 22, wherein the means for determining the filtered speed feedback value uses the relationship:

$$sfb_f = \frac{\lambda}{s+\lambda} \cdot sfb \text{ where:}$$

$sfb_f$=filtered speed feedback value;

sfb=speed feedback value;

λ=filter cutoff frequency; and s=Laplace operator.

27. A hoist system for determining the load value of a lifted load in a hoist system, comprising:

means for determining a speed feedback value from the hoist system;

means for processing the speed feedback value including using a filter to filter the speed feedback value to provide a filtered speed feedback value, the processing further including comparing the filtered speed feedback value with the speed feedback value to provide an acceleration value;

means for determining a torque feedback value from the hoist system;

means for determining a loss torque value and an inertia value from the hoist system;

means for inputting a previously determined load value;

means for processing the torque feedback value including using the filter to provide a filtered torque feedback value, the processing further including adjusting the filtered torque feedback value using the loss torque value, the previously determined load value, and the inertia value to determine an adjusted filtered torque feedback value;

means for comparing the acceleration value with the adjusted filtered torque feedback value to determine an error value; and means for determining a measured load value based on the error value.

28. The hoist system according to claim 27, wherein the filter includes a Laplace operator that represents information from at least one previous speed feedback value determination.

29. The hoist system according to claim 27, further including means for comparing the measured load value to a threshold load value to determine a slack cable condition, wherein the means for comparing terminates operation of the hoist system if the threshold load value is exceeded.

30. The hoist system according to claim 27, further including means for comparing the measured load value to a threshold overload value to determine an overload condition, wherein the means for comparing terminates operation of the hoist system if the threshold overload load value is exceeded.

31. The hoist system according to claim 27, further including means for comparing the measured load value to a threshold value to determine a snagged load condition, wherein the means for comparing terminates operation of the hoist system if the threshold value is exceeded.

32. A hoist system for controlling the hoist of a load, the hoist system comprising:

a hoist mechanical system that includes a cable, the cable attachable to the load;

an adjustable speed drive, the adjustable speed drive operationally connected to the hoist mechanical system;

a load measurement portion in communication with the adjustable speed drive, the adjustable speed drive communicating torque feedback and speed feedback to the load measurement portion, wherein:

the load measurement portion filters the torque feedback and speed feedback using a filter to generate filtered torque feedback and the filtered speed feedback; and the load measurement portion processes the filtered torque feedback and the filtered speed feedback using a previously determined load measurement, the load measurement portion outputting a load value signal to control the speed of a hoist based on the load value signal.

33. The hoist system according to claim 32, wherein the system further includes a speed-load portion; and the load measurement portion outputting the load value signal to the speed-load portion; and the speed-load portion outputting a speed reference scale factor to the adjustable speed drive.

34. The hoist system according to claim 32, wherein the filter is a first order filter in the Laplace domain.

35. A hoist system for controlling the hoist of a load, the hoist system comprising:

a hoist mechanical system that includes a cable and a motor, the cable attachable to the load and controllable by the motor;

an adjustable speed drive, the adjustable speed drive operationally connected to the motor so as to control the motor;

a load measurement portion in communication with the adjustable speed drive, the adjustable speed drive communicating torque feedback, speed feedback, and brake status to the load measurement portion, the load measurement portion obtaining a loss torque value and an inertia value of the hoist mechanical system, wherein:

the load measurement portion filters the torque feedback and speed feedback using a filter to generate filtered torque feedback and the filtered speed feedback; and the load measurement portion processes the filtered torque feedback and the filtered speed feedback using a previously determined load measurement, the loss torque value and the inertia value of the hoist mechanical system, the load measurement portion outputting a load value signal to control the speed of a hoist based on the load value signal.

* * * * *